United States Patent [19]

Pittard, Jr.

[11] 4,351,075

[45] Sep. 28, 1982

[54] COMBINATION OIL PLUG WRENCH AND INTEGRAL OIL FILLER

[76] Inventor: Hal K. Pittard, Jr., 4201 Bland Rd., Raleigh, N.C. 27609

[21] Appl. No.: 164,672

[22] Filed: Jun. 30, 1980

[51] Int. Cl.[3] ..... B25F 1/00; B25B 13/48

[52] U.S. Cl. ..... 7/138; 7/152; 81/90 D; 81/121 R; D8/17

[58] Field of Search ..... 7/100, 138, 151, 152, 7/156; 81/90 R, 121 A, 90 C, 177 N, 90 D, 121 R, 58.1; 248/359, 360, 316 D; D8/16, 17; 220/85 SP; 222/538; 30/408, 407

[56] References Cited

U.S. PATENT DOCUMENTS

| | | | |
|---|---|---|---|
| 151,635 | 6/1874 | Uhlinger | 81/121 A |
| D. 234,451 | 3/1975 | Bloom | D8/17 |
| 1,270,705 | 6/1918 | Croad | 81/90 D |
| 2,099,430 | 11/1937 | Quea | 30/408 |
| 2,423,145 | 7/1947 | Halm | 81/121 R |
| 2,461,639 | 2/1949 | Grigalunas | 7/138 |
| 2,567,563 | 9/1951 | Hribar | 81/121 R |
| 2,773,272 | 12/1956 | Harrah | 7/152 |
| 4,253,356 | 3/1981 | Martinmaas | 81/177 M |

FOREIGN PATENT DOCUMENTS

| | | | |
|---|---|---|---|
| 2390251 | 1/1979 | France | 7/151 |

*Primary Examiner*—Roscoe V. Parker
*Attorney, Agent, or Firm*—Mills and Coats

[57] ABSTRACT

The present invention relates to a combination tool including an oil plug wrench and an integrally constructed elongated oil filler trough. To accommodate oil plugs of the type having a cap portion with upstanding studs or protrusions, the combination tool includes a wrench end with one or more openings formed therein to receive the upstanding protrusions from the oil cap. Integrally constructed with the wrench end is a trough-like device that is adapted to receive and channel oil towards an exiting end thereof. Additionally there is provided a can opener about the exiting end of the formed oil filler trough.

7 Claims, 5 Drawing Figures

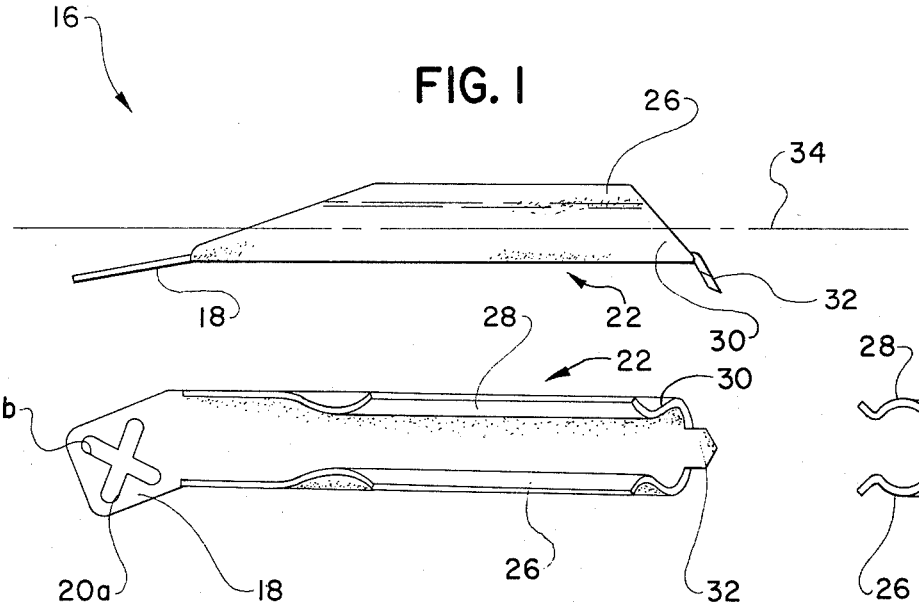
FIG. 1
FIG. 2
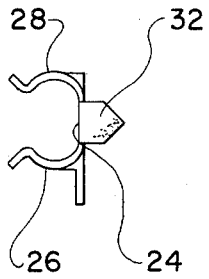
FIG. 3
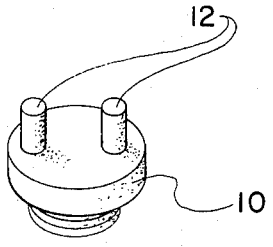
FIG. 4
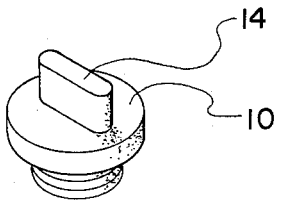
FIG. 5

COMBINATION OIL PLUG WRENCH AND INTEGRAL OIL FILLER

FIELD OF INVENTION

The present invention relates to tools and implements and more particularly to combination tools of the type having a wrench end for fitting lawn mower oil plugs having upstanding protrusion elements, and an integrally formed oil filler section extending therefrom.

BACKGROUND OF INVENTION

Lawn mowers commonly utilize an oil plug that includes a top cap portion with one or more upstanding studs or projecting elements. Often such oil plugs are positioned about the mower where access is difficult and awkward to reach. Generally to unscrew these types of oil plugs, an elongated member such as a screwdriver is recommended. The screwdriver, for example, is inserted between the upstanding studs and is rotated, loosening the oil plug in the process. As noted above, typically these oil plugs are placed in cramped and awkward areas and it is quite difficult to properly insert a screwdriver between the upstanding studs, and even more difficult to turn the screwdriver once the same has been properly inserted.

Further even after removing the oil plug then one discovers that it is a difficult task to simply pour oil into the oil opening, again because of the location and position of the oil opening. Normally to avoid spillage, a funnel is required, but often a funnel is not conveniently at hand and the individual resorts to pouring the oil from a can.

Therefore, it is appreciated that the design and particular positioning of such lawn mower oil plugs does present a problem for the user in adding oil. The difficulty of removing the oil plug and pouring oil into the oil opening does in fact discourage lawn mower owners from properly maintaining their lawn mower.

SUMMARY OF INVENTION

The present invention entails a combination tool especially designed to alleviate the above-discussed problems with respect to lawn mower oil caps. In this regard, the combination tool of the present invention is provided with a wrench end designed to receive the upstanding studs or projecting elements from such an oil cap, whereby by turning the wrench end the oil cap can be removed or tightened about the oil opening. Further as a part of the combination tool, there is provided an integral oil filler section that extends from the wrench end. The oil filler section functions as a funnel or oil channeler for guiding and channeling the oil from an oil container into the oil opening without the oil spilling. In addition, the combination tool including the oil cap wrench end and oil filler section is provided with a can opener and also designed such that the oil filler section may snap onto the handle of a lawn mower such that it may be kept within convenient reach.

It is, therefore, an object of the present invention to provide a multi-functional combination tool having a wrench end for conveniently removing lawn mower oil caps of the type having one or more upstanding studs, and which is provided with an integral oil filler section for channeling or funneling oil.

Another object of the present invention resides in the provision of a combination tool of the character referred to above which is further provided with a can opener for opening oil cans.

It is also an object of the present invention to provide a combination tool of the character referred to above that is provided with means for snapping the same onto the handle of the lawn mower wherein the entire tool can be maintained in convenient reach.

Another object of the present invention resides in the provision of a combination tool having a wrench end for fitting lawn mower oil caps wherein the wrench end is designed to receive and fit a plurality of different oil cap designs having different types of upstanding turning elements.

A further object of the present invention resides in the provision of a combination tool having a wrench end for fitting lawn mower oil plugs and an integral oil filler section that is of an open top trough design wherein the oil filler section is designed to snap around the handle of a lawn mower where the same can be conveniently carried.

Other objects and advantages of the present invention will become apparent from a study of the following description and the accompanying drawings which are merely illustrative of the present invention.

BRIEF DESCRIPTION OF DRAWINGS

FIGS. 1, 2 and 3 respectively show three different views of the combination tool of the present invention, the upper view being a side elevational view, the left lower view being a top plan view, and the lower right view being an end view.

FIG. 4 is a perspective view of an oil cap or plug with upstanding turning studs.

FIG. 5 is another view of an alternate oil cap or plug with a single turning ridge or stud.

COMBINATION OIL PLUG WRENCH AND INTEGRAL OIL FILLER

With further reference to the drawings, a lawn mower oil cap or plug is shown therein and indicated by the numeral 10. A oil cap or plug 10 is of the type provided with upstanding studs for turning purposes. In particular, one such oil cap or plug 10 is provided with a pair of spaced apart upstanding studs or projecting elements 12. These projecting studs 12 can be round, square or any desired configuration. Alternately, oil cap 10 can be provided with a ridge type turning stud 14, as shown in FIG. 5.

As will become apparent from subsequent portions of this disclosure, lawn mower oil cap 10 is designed to be turned by engaging the studs or stud projecting upwardly from the oil cap 10. As discussed hereinabove, in the case of the pair of projecting studs 12, it has been common practice in the past to insert an elongated member between the respective studs 12, such as a screw driver, and then to rotate the elongated member to either loosen or tighten the oil plug 12 within the oil opening.

Turning now to the combination tool of the present invention, the same is shown in FIG. 1 and indicated generally by the numeral 16. Combination tool 16 includes a wrench end 18 that is provided with opening means formed therein to receive and to fit the respective studs 12 or 14 that extend or project upwardly from the oil cap 10. In the case of a preferred embodiment, the opening means formed within wrench end 18 is of the design shown in FIG. 2 and is described as being formed by two elongated slot openings **20*a* and 20*b* that cross each other about the mid-point area of each. It follows that this design will accommodate both the pair of projecting studs 12, either round or square, and the single ridge type stud 14**.

In the case of the pair of projecting studs 12, it is seen that the wrench end 18 can be fitted on top of the oil cap 10 such that the respective studs 12 occupy extreme spaced apart positions within either elongated slot 20*a* or 20*b*.

Integrally constructed with wrench end 18 is an elongated oil filler section 22. In the preferred embodiment shown herein, the oil filler section 22 is of an open top trough type in that the same includes a channeling surface 24 and opposed upstanding side retaining walls 26 and 28 that extend parallel to the longitudinal axis 34 thereof. About the end opposite the wrench end 18, there is what is referred to as an oil exiting end 30.

In the embodiment illustrated herein, the oil filler section 22 is of a generally arcuate or curved shape cross section, as illustrated in FIG. 3.

To provide a snap-on feature for the combination tool 16 of the present invention, side retaining walls 26 and 28 are designed such that the space therebetween is adapted to snap-on and receive a conventional size handle of a lawn mower. To accommodate this, the side retaining walls 26 and 28 are constructed of material, preferably metal or plastic, such that they will yield to receive the lawn mower handle. In addition, side retaining walls 26 and 28 would be designed such that they would tend to snap around the lawn mower handle to firmly hold the combination tool 16 thereabout.

Finally to provide further utility for combination tool 16 of the present invention, about the exiting end 30 of the oil filler section 22, there is provided a can opener 32 which is of the spade type and which can be used to open oil cans.

Therefore, it is appreciated that the combination tool 16 of the present invention can be first utilized to loosen or tighten the lawn mower oil plug 10 by inserting the opening means formed within the wrench end 18 about the upstanding studs 12 or 14 of the oil cap. The combination tool 16 is of a relatively short length such that it can be turned and rotated in close areas.

Once oil cap 10 has been removed, the combination tool can be oriented such that exiting end 30 is placed into or adjacent the oil opening from which cap 10 was removed. Then the combination tool 16 is placed at an incline and oil can be poured into the trough-like oil channeling surface where the oil flows down the oil filler section 22 towards the exiting end 30 and into the oil opening.

The terms "upper", "lower", "forward", "rearward", etc., have been used herein merely for the convenience of the foregoing specification and in the appended claims to describe the combination tool and its parts as oriented in the drawings. It is to be understood, however, that these terms are in no way limiting to the invention since the combination tool may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A combination oil plug wrench and integral oil filler for tightening and disengaging an oil plug of the type provided with a lawn mower and including a cap having a top and upstanding projection turning means extending upwardly from said top and adapted to be engaged for turning said oil plug with said upstanding projection turning means being relatively thin compared to the top of said cap and including spaced apart opposed ends so as to define a relatively thin and elongated turning area between said opposed ends, and wherein said oil filler may be utilized to funnel or channel oil from a container into an opening normally occupied by said oil plug, said combination oil plug wrench and integral oil filler comprising: a wrench end having a relative flat surface with opening means formed therein for receiving and encasing said upstanding projection turning means extending upwardly from said oil cap and for turning the same as said wrench end is rotated, said opening means of said wrench end including an opening for receiving and encasing the relatively thin and elongated turning area between said opposed ends of said turning means; a combination wrench handle and an elongated U-shaped oil filler section integrally constructed with said wrench end and extending therefrom, said oil filler section including an open ended oil channeling surface, an oil exiting end, and side retaining means that extend about said oil channeling surface for constraining the oil to flow essentially down said oil channeling surface towards said oil exiting end, and wherein said oil channeling surface and said side retaining means thereof form an elongated, generally U-shaped and partially open trough structure; and an oil receiver section means interposed between the relatively flat surface of said wrench end having said opening means formed therein and said filler section for receiving oil poured therein that is directed through said U-shaped filler section towards said exiting end, and wherein said oil receiver section means includes a generally U-shaped cross section with side retaining means integrally extended to join said side retaining means of said filler section and wherein the side retaining means of said oil receiver section means are generally uniformly inclined upwardly from said flat wrench end towards said filler section so as to define a generally horizontal resting surface about the upper edges thereof for supporting said container when said combination oil plug wrench and oil filler section is disposed at an appropriate incline for filling purposes.

2. The combination oil plug wrench and integral oil filler of claim 1 wherein said opening means formed within said wrench end includes a plurality of radially spaced openings for receiving said projection means extending upwardly from said oil cap.

3. The combination oil plug wrench and integral oil filler of claim 1 wherein said opening means formed in said wrench end includes a continuous cross type opening having two crossing elongated slot openings, each elongated slot opening extending generally across the mid-point area of the other elongated slot.

4. The combination oil plug wrench and integral oil filler of claim 1 further including a can opener provided therewith.

5. The combination oil plug wrench and integral oil filler of claim 4 wherein said can opener includes a pointed spade-like member secured to the oil exiting end of said oil filler section and extending generally in a plane perpendicular to the longitudinal axis of said oil filler section.

6. The combination oil plug wrench and integral oil filler of claim 1 further including snap-on means for snapping the entire combination oil plug wrench and integral oil filler to a handle.

7. The combination oil plug wrench and integral oil filler of claim 6 wherein said side retaining means forms a trough-like structure which is yieldable and forms said snap-on means, whereby the entire combination wrench and integral oil filler can be snapped onto a handle such as a lawn mower handle and retained thereon until removed.

* * * * *